United States Patent [19]

Weatherup et al.

[11] Patent Number: 4,758,766

[45] Date of Patent: Jul. 19, 1988

[54] GAS DISCHARGE DEVICES UTILIZING ELECTRON INJECTION FOR GAS IONIZATION

[75] Inventors: Clifford R. Weatherup, Chelmsford, England; Arthur Maitland, St. Andrews, Scotland

[73] Assignee: English Electric Valve Company Limited, Chelmsford, England

[21] Appl. No.: 810,303

[22] Filed: Dec. 18, 1985

[30] Foreign Application Priority Data

Dec. 22, 1984 [GB] United Kingdom ..... 8432612

[51] Int. Cl.[4] ..... H01J 1/46; H01J 15/02

[52] U.S. Cl. ..... 313/595; 313/599; 313/597

[58] Field of Search ..... 313/595, 597, 599, 600, 313/601, 602, 306, 310, 325, 231.41, 359.1, 360.1

[56] References Cited

U.S. PATENT DOCUMENTS

| | | | |
|---|---|---|---|
| 3,612,937 | 10/1971 | Smirnov | 313/601 |
| 4,429,253 | 1/1984 | Donaldson et al. | 313/599 X |
| 4,577,138 | 3/1986 | Menown et al. | 313/597 X |

FOREIGN PATENT DOCUMENTS

| | | |
|---|---|---|
| 913956 | 12/1962 | United Kingdom . |
| 987371 | 3/1965 | United Kingdom . |
| 1060309 | 3/1967 | United Kingdom . |
| 1084908 | 9/1967 | United Kingdom . |
| 1094738 | 12/1967 | United Kingdom . |
| 1140374 | 1/1969 | United Kingdom . |
| 1334527 | 10/1973 | United Kingdom . |
| 1518360 | 7/1978 | United Kingdom . |
| 1583493 | 1/1981 | United Kingdom . |
| 2153140A | 8/1985 | United Kingdom . |

*Primary Examiner*—David K. Moore
*Assistant Examiner*—K. Wieder
*Attorney, Agent, or Firm*—Spencer & Frank

[57] ABSTRACT

A gas discharge device includes an anode, an enclosure member having an aperture therein and substantially enclosing a volume of a gas filling, and a mechanism for injecting electrons into the volume of gas filling to produce ionization of the gas filling within the volume so that during operation of the device, the enclosure member and the ionization within the enclosure member constitute a cathode, and a conduction path is established between the interior of such cathode and the anode through the aperture of the enclosure member.

11 Claims, 2 Drawing Sheets

GAS DISCHARGE DEVICES UTILIZING ELECTRON INJECTION FOR GAS IONIZATION

BACKGROUND OF THE INVENTION

This invention relates to gas discharge devices and more particularly, but not exclusively, to thyratrons.

A thyratron is a device which includes an anode and a cathode. The cathode may be what is termed a 'cold cathode', that is, one which emits electrons when it is subjected to a large enough electric field. Such cold cathodes have advantages over heated cathodes in that they become emitting as soon as a discharge voltage is established between the anode and the cathode. Also a cold cathode does not require a heater filament.

However, conventional cold cathodes suffer from a significant disadvantage when used in thyratrons or lasers in that the lifetime of a cold cathode is generally short, being of the order of 50 to 100 hours.

SUMMARY OF THE INVENTION

According to a first aspect of the invention there is provided a gas discharge device, including: an anode, an enclosure member having an aperture therein and substantially enclosing a volume of a gas filling, and means for producing ionization of the gas filling within the volume, such that during operation of the device the enclosure member and the ionization comprise a cathode, and a conduction path is established between the interior of the cathode and the anode through the aperture.

According to a second aspect of the invention there is provided a gas discharge device, including: an anode, an enclosure member having an aperture therein and substantially enclosing a volume of a gas filling, and means for introducing electrons into the volume to produce ionization of the gas filling within the volume, such that during operation of the device the enclosure member and the ionization comprise a cathode, and a conduction path is established between the interior of the cathode and the anode through the aperture.

The invention may be advantageously used in any device requiring the production of a plasma to establish a discharge in a gas filled device, for example, it may be used in a laser or thyratron.

By employing the invention, cathode lifetimes of the order of thousands of hours may be achieved.

Where electrons are introduced into the volume to produce ionization of the gas filling, they must have an energy sufficient to give a plasma of positive ions and electrons. The plasma causes electrons to be emitted by the inner surface of the enclosure member, and thus the ionization and enclosure member combine to act as an effective cathode.

Preferably electrons introduced into the volume are arranged to pass through the aperture. The ionization produced by the electrons after they have passed through the aperture may then be used to trigger the main discharge of the thyratron.

It is preferred that the means for introducing electrons comprises one or more electron emitting members outside of the enclosure member and each communicating with the gas volume via a respective hole in an outside wall of the enclosure member.

Preferably, the electrons introduced into the volume are produced by an electron emitting member having a hole in a surface thereof and wherein, except within the hole, at least substantially the whole of the surface of the electron emitting member is covered with an electrically insulating material, an electron beam being produced extensive of the hole when a suitably high voltage is applied between the electron emitting member and an associated anode. Such an electron emitting member is described in our co-pending UK patent application No. 2,153,140A and corresponding copending U.S. patent application Ser. No. 683,035. The electron emitting member produces a beam of electrons which tends to be well collimated. This is an advantage in that the electron emitting member may be placed some distance from the enclosure member and the electron beam directed through a hole in the enclosure member to the volume. Thus the electron emitting member may be spaced from the volume in which ionization takes place and which may cause deterioration of the electron emitting member.

Preferably the enclosure member acts as an anode for the electron emitting member, although a separate anode may be provided, for example, it might surround the electron emitting member and be placed behind the surface in which the hole is formed. Also it is preferred that a plurality of electron emitting members are included.

Preferably the gas filling is of hydrogen, although deuterium or some other gas, or mixture of gases, may be employed. It is also preferred that the member is of molybdenum, although for example it could be of high purity nickel or of tungsten.

Preferably the member is integral with a support structure for another element, such as for example a control grid in a thyratron, giving added strength and robustness to the apparatus, although it may, of course, be separate.

The device is advantageously a thyratron.

BRIEF DESCRIPTION OF THE FIGURES

The invention is now further described by way of example with reference to the accompanying drawing in which.

DETAILED DESCRIPTION

Figure 1:
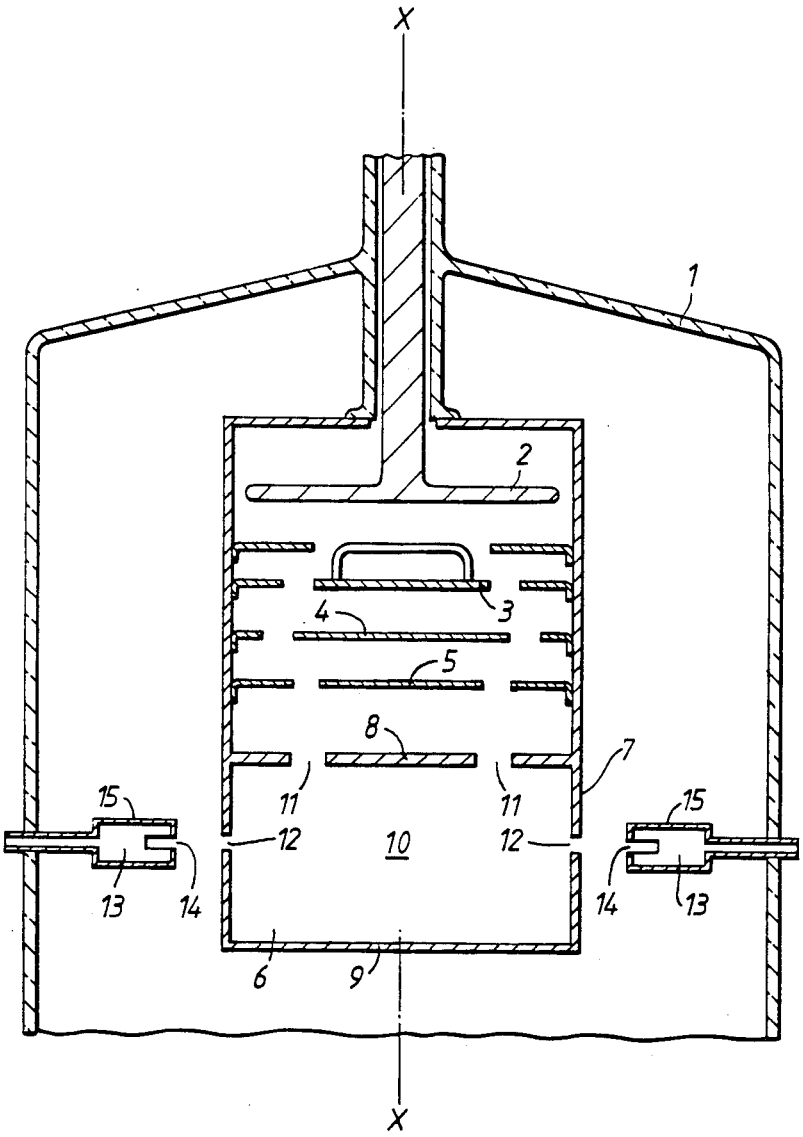
FIG. 1 is part of a longitudinal section of a thyratron in accordance with the invention.

With reference to FIG. 1, a thyratron includes a glass envelope 1 (only part of which is shown) which contains a filling of hydrogen gas at a pressure of about 0.5 Torr. An anode 2, screen grid 3 and control grids 4 and 5 are also contained within the envelope 1 and are similar to those employed in a conventional thyratron.

A hollow cylindrical enclosure member having a height and diameter of about 50 mm and enclosing a volume 6, is also contained within the envelope 1, and consists of a side wall 7 and end walls 8 and 9 of molybdenum. The cylindrical enclosure member is co-axial with the longitudinal axis X—X of the thyratron, the screen grid 3, and control grids 4 and 5 lying between it and the anode 2. An arcuate aperture 11 is included in the end wall 8 which is nearest the control grid 5. The side wall 7 includes nine apertures 12 having a diameter of a few millimetres, only two of which are shown. The apertures 12 are spaced equidistant around a circumference of the side wall 7.

Nine electron emitting members in the form of cylindrical rods 13 of tungsten, again only two of which are shown, are arranged around the outside of the enclosure member and are also spaced equidistant around the circumference, each being associated with a respective aperture 12. Each rod 13 has a hole 14 in its front surface extending along its longitudinal axis which is perpendicular to the axis X—X of the thyratron. Each hole 14 is alinged with the aperture 12 associated with that rod 13. The whole surface of each rod 13 contained within the envelope 1 is coated with a glass layer 15, except for that part of the surface forming the base or wall of the hole 14.

In operation, the walls 7, 8 and 9 of the enclosure member are earthed and a positive potential is applied to the anode 2. When a thyratron is to become conducting a negative potential is applied to the rods 13, the enclosure member thus being at positive potential with respect to them. An electron beam then forms extensive of each hole 14 and in a direction away from it. The electron beams pass through the apertures 12 and enter the volume 6. These electrons cause ionization of the gas filling contained by the enclosure member to produce a plasma of positive ions and electrons. Thus the enclosure member and the ionization within the volume 6 combine to form a cathode 10. The main discharge then occurs when the thyratron is triggered into its conducting state.

The thyratron could be arranged such that the rods 13 are always maintained at negative potential to produce beams of electrons, and the main discharge is initiated by voltages of up to 5 kV applied to the control grids 4 and 5.

An alternative form of operation is to pulse the rods 13 with a current of up to 500 A for up to 1.0 microsecond before a pulse is applied to the grids 4 and 5.

The cathode 10 formed by the enclosure member and the ionization is capable of sustaining curent pulses of 10–15 kA lasting from 10–15 microseconds.

Figure 2:
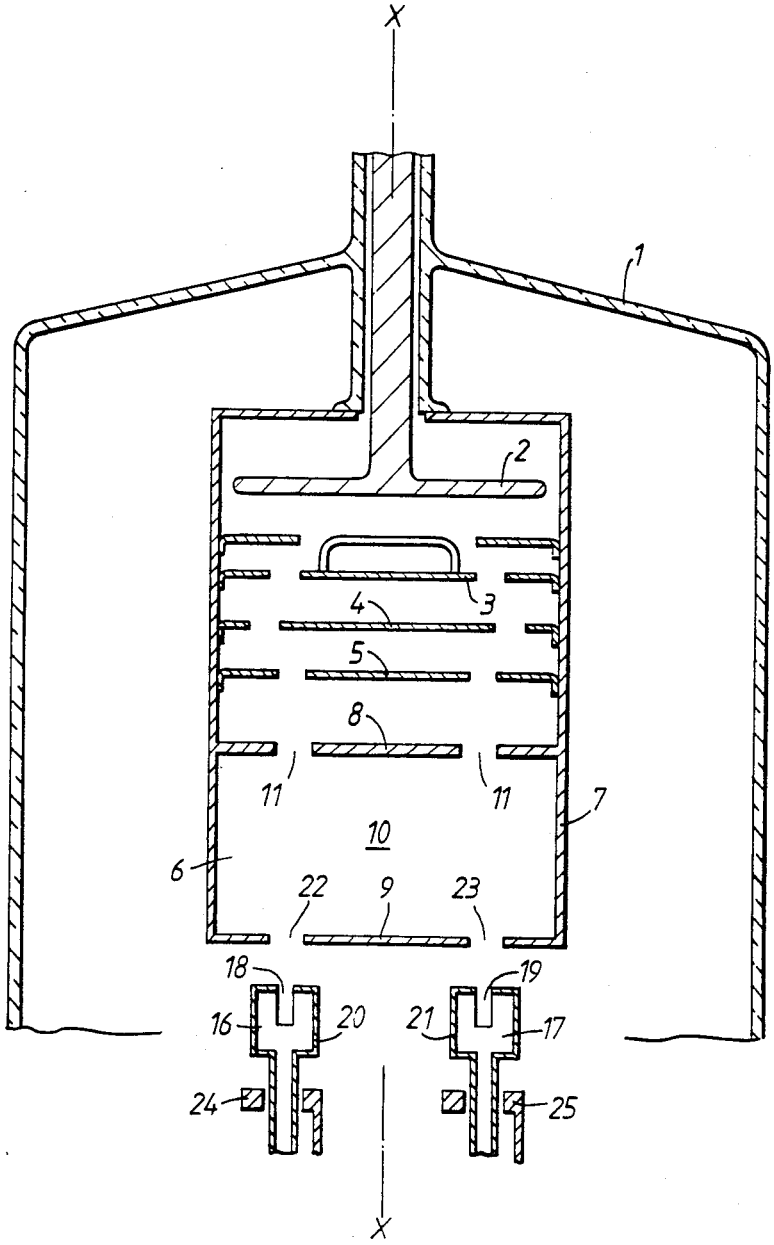
FIG. 2 is part of the longitudinal section of another thyratron in accordance with the invention, with like reference being used for like parts.

With reference to FIG. 2, a thyratron is shown which is similar to that of FIG. 1. However, instead of having nine rods spaced around the circumference of the side wall 7, two cylindrical tungsten rods 16 and 17 are located adjacent the end wall 9. Each of the rods 16 ad 17 has a hole 18 and 19, respectively, in its front surface, and the surface of each rod, save for within the hole, is coated with a layer 20 and 21, respectively, of glass. Each of the holes 18 and 19 is aligned with a respective aperture 22 and 23 in the end wall 9. Anode members 24 and 25 coaxially surround the rods 16 and 17, respectively, and are located behind ther front surfaces.

When a suitably high voltage is applied between the rods 16 and 17 and their respective anodes 24 and 25 electron beams are formed extensive of the holes 18 and 19 and penetrate via the apertures 22 and 23 into the volume 6 where the gas filling becomes ionized. The rods 16 and 17 are also arranged to be aligned with aperture 11 in the end wall 8 such that the electron beams penetrate therethrough. Thus, ionization may also be produced within the region between the end wall 8 and control grid 5, and may be used to trigger the main thyratron discharge.

We claim:

1. A gas discharge device, including: an anode, an enclosure member having an aperture therein and substantially enclosing a volume of a gas filling, and means for injecting electrons into said volume of gas filling to produce ionization of the gas filling within said volume such that during operation of said device, said enclosure member and the ionization of the gas filling within said enclosure member comprise a cathode, and a conduction path is established between the interior of said cathode and said anode through the aperture of said enclosure member.

2. A device as claimed in claim 1, and wherein said enclosure member is arranged so that electrons injected into said volume pass through said aperture.

3. A device as claimed in claim 1, and wherein said means for injecting electrons comprises one or more electron emitting members located outside of said enclosure member, each said electron emitting member communicating with said volume via a respective hole in an outside wall of said enclosure member.

4. A device as claimed in claim 1, and wherein said means for injecting electrons into said volume comprises an electron emitting member having a hole in a surface thereof and wherein, except within the hole, at least substantially the whole of the surface of the electron emitting member is covered with an electrically insulating material, electrons being produced extensive of the hole when a suitably high voltage is applied between said electron emitting member and an anode.

5. A device as claimed in claim 3, and wherein said enclosure member acts as an anode for the electron emitting member.

6. A device as claimed in claim 3, and including a plurality of electron emitting members spaced equidistant around said enclosure member.

7. A device as claimed in claim 1, and wherein said gas filling is hydrogen.

8. A device as claimed in claim 1, and wherein said enclosure member is of molybdenum.

9. A device as claimed in claim 1, and wherein said enclosure member is integral with a support structure for another element.

10. A device as claimed in claim 1 and wherein said gas filling is at a pressure of approximately 0.5 Torr.

11. A device as claimed in claim 1, and wherein said device is a thyratron.

* * * * *